US005540552A

United States Patent [19]

Surdi

[11] Patent Number: 5,540,552

[45] Date of Patent: Jul. 30, 1996

[54] TURBINE ENGINE ROTOR HAVING AXIAL OR INCLINED, ISSUING BLADE GROOVES

[75] Inventor: Jean M. Surdi, Rubelles, France

[73] Assignee: Societe Nationale d'Etude et de Construction de Moteurs d'Aviation "SNECMA", Paris, France

[21] Appl. No.: 382,762

[22] Filed: Feb. 2, 1995

[30] Foreign Application Priority Data

Feb. 10, 1994 [FR] France ..... 94 01489

[51] Int. Cl.[6] ..... F01D 5/32

[52] U.S. Cl. ..... 416/220 R

[58] Field of Search ..... 416/219 R, 220 R, 416/221

[56] References Cited

U.S. PATENT DOCUMENTS

| | | | |
|---|---|---|---|
| 4,453,890 | 6/1984 | Brantley | 416/220 R |
| 4,470,756 | 9/1984 | Rigo et al. | 416/220 R |
| 4,478,554 | 10/1984 | Surdi | 416/220 R |
| 4,604,033 | 8/1986 | Surdi | 416/220 R |
| 5,211,407 | 5/1993 | Glynn et al. | 416/220 R |

FOREIGN PATENT DOCUMENTS

| | | | |
|---|---|---|---|
| 2492906 | 4/1982 | France | 416/221 |
| 2561307 | 9/1985 | France | 416/220 R |
| 2585069 | 1/1987 | France . | |
| 2681374 | 3/1993 | France . | |
| 1628359 | 10/1973 | Germany . | |
| 739870 | 11/1955 | United Kingdom . | |
| 2006883 | 5/1979 | United Kingdom . | |
| 2058945 | 4/1981 | United Kingdom . | |
| WO90/05837 | 5/1990 | WIPO . | |

*Primary Examiner*—James Larson

*Attorney, Agent, or Firm*—Oblon, Spivak, McClelland, Maier & Neustadt, P.C.

[57] ABSTRACT

A turbine engine rotor includes two bolted, coaxial sections. One of the sections carries blades engaged by their roots in through broachings. The axial force exerted on the blades by the centrifugal operating component due to the inclination of the broaching is not transmitted to the bolts joining the two sections as a result of a mounting where the flanges are joined at their rear faces. The blades abut against the flange of the other of the sections. The invention is more particularly applicable to highly curved, so-called large chord blades of a turbine engine fan and the other of the sections is then a low pressure compressor drum.

6 Claims, 3 Drawing Sheets

TURBINE ENGINE ROTOR HAVING AXIAL OR INCLINED, ISSUING BLADE GROOVES

BACKGROUND OF THE INVENTION

1. Field of the Invention

The invention relates to a turbine engine rotor having axial or inclined, issuing blade grooves.

2. Discussion of the Related Art

A standard manner of fixing blades to the rotary part carrying them consists of forming grooves in the contour thereof by axial or inclined broachings, which can be either inwardly curved or rectilinear and into which are slid the blade roots. As the roots are bulb-shaped and the grooves are closed up at the surface, it is not possible to extract the blades by a centrifugal movement and annular parts are located on both sides of the rotary part in order to again close the grooves and lock the blades in translation.

Conventionally the rotary part forms a first section of the rotor, which is bolted to a second, adjacent section of the rotor by respective flanges. This design is described in the applicant's French patent 2 585 069. The flange of the first section is interrupted by broachings and is consequently discontinuous, whereas that of the second section is continuous and therefore serves as a translation abutment for this side of the blades. This design suffers from the disadvantage that the axial component of the blades due to the centrifugal force in operation combined with the inclination of the broachings is transmitted to the joining bolts of the flanges in the form of a supplementary tensile force and they are consequently highly loaded

SUMMARY OF THE INVENTION

An object of the invention consists of avoiding this overload. In its most general form, the invention can be defined as a turbine engine rotor comprising a first and a second coaxial sections bolted together by flanges, the first section having grooves for retaining the blade roots issuing in front of the second section and characterized in that the flanges are interlocked by their rear faces and the blades abut against the flange of the second section.

In the sense of the invention, the rear faces of the flanges are oriented towards the section or part carrying the flange and the front faces are directed towards the other of the sections. In their normal applications, e.g. for connecting pipes, the flanges are coupled together by their front faces, so that the structure according to the invention differs therefrom.

BRIEF DESCRIPTION OF THE DRAWINGS

The invention is described in greater detail hereinafter relative to non-limitative embodiments and the attached drawings, wherein show.

DESCRIPTION OF THE PREFERRED EMBODIMENTS

Figure 1:
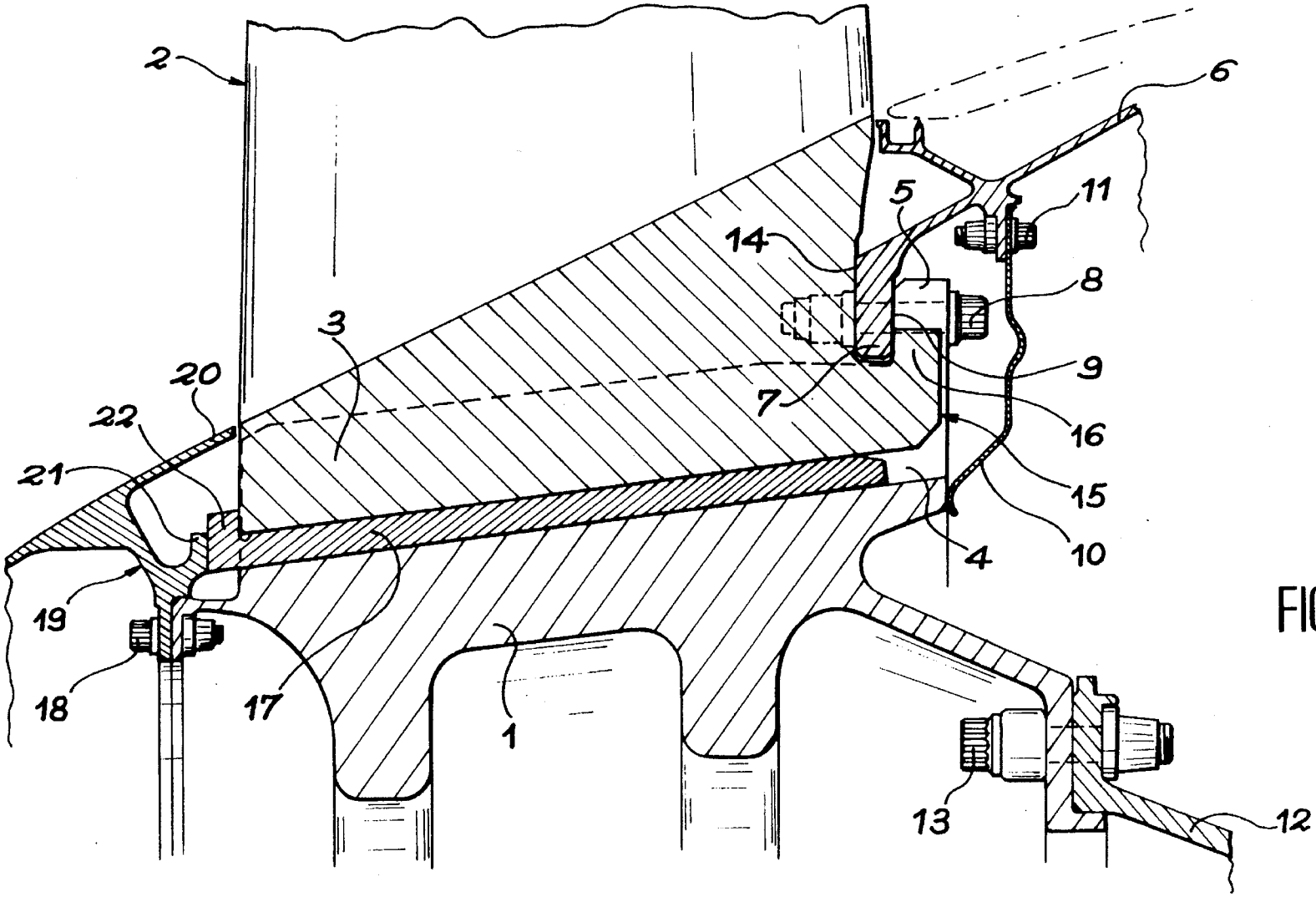
FIGS. 1 and 2 Two embodiments of the invention in longitudinal section.

In FIG. 1, a fan disk 1 of a turbine engine carries blades 2, which are in the form of large chord blades, i.e. highly curved between the leading and trailing edges to the front and rear. The blade roots 3 by which they are joined to the fan disk 1 are optionally circular arc-shaped, so as not to have an excessive width and resulting weight. They are introduced into respective broachings 4 on the periphery of the fan disk 1 and have the same curvature. These broachings 4 issue on the two upstream and downstream sides of the fan disk 1. On the downstream side, they pass through a disk flange 5 extending radially towards the outside and subdivide it into separate portions. They are inclined, i.e. have an overall conical arrangement and diverge towards the downstream side, so as to roughly follow the increase in the diameter of the gas flow stream in order to avoid having excessively deep and heavy roots. The centrifugal force exerted on the blades 2 is consequently transmitted to the rotor with a downstream component.

A compressor drum 6 is joined to the fan disk 1, which extends in the downstream direction while being coaxial thereto. It tapers in the upstream direction in a conical shape and is terminated by a continuous drum flange 7 and extends radially towards the inside. The flanges 5 and 7 have portions located at the same diameters and by which it is possible to couple them together by bolts 8. Unlike in the conventional arrangement, the fan disk 1 and compressor drum 6 are interlocked or partly overlap in the axial direction, the flanges 5 and 7 being joined by their respective rear faces, which are joined so as to form an interface 9, i.e. at the upstream face of the disk flange 5 and the downstream face of the drum flange 7.

Mounting easily takes place by introducing the fan disk 1 into the compressor drum 6 by the downstream side and then displacing it in the upstream direction until abutment occurs and then the bolts 8 can be put into place. It is then possible to screw down a sealing collar 10, which extends in front of the disk flange 5 to the downstream side thereof by means of other bolts 11 to the compressor drum 6 in order to cover the broachings 4 and therefore ensure the necessary sealing. The fan disk 1 can be joined to the drive shaft 12 surrounding the compressor drum 6 by other bolts 13.

The blades 2 are then introduced into the broachings 4 by making them slide in the downstream direction until the trailing edge thereof touches the front face 14 (upstream face) of the drum flange 7. The roots 3 are extended in the downstream direction by a hook 15, which is passed beneath the drum flange 7 and whereof the end 16 pointing radially towards the outside is positioned to the right of the disk flange 5. It is merely necessary to introduce shims 17 to the bottom of the broachings 4 in order to raise the blades 2 and slide the end 16 of the hook 15 behind the drum flange 7 and complete the fixing of the blades 2. Other bolts 18 join the upstream side of the fan disk 1 to the fan cone 19, which has a conical, outer face 20 covering the other end of the broachings 4 issuing towards the upstream side and a collar 20 pushing a shoe 22 to the rear of the shims 17. The shoe 22 is wedged between the collar 21 and the root 3 when the mounting is completed. Thus, the shims 17 are locked in translation in the broachings 4 like the blades 2. It can be seen that the axial force due to the operating centrifugal component of the blades 2 is not transmitted to the bolts 8.

Figure 2:
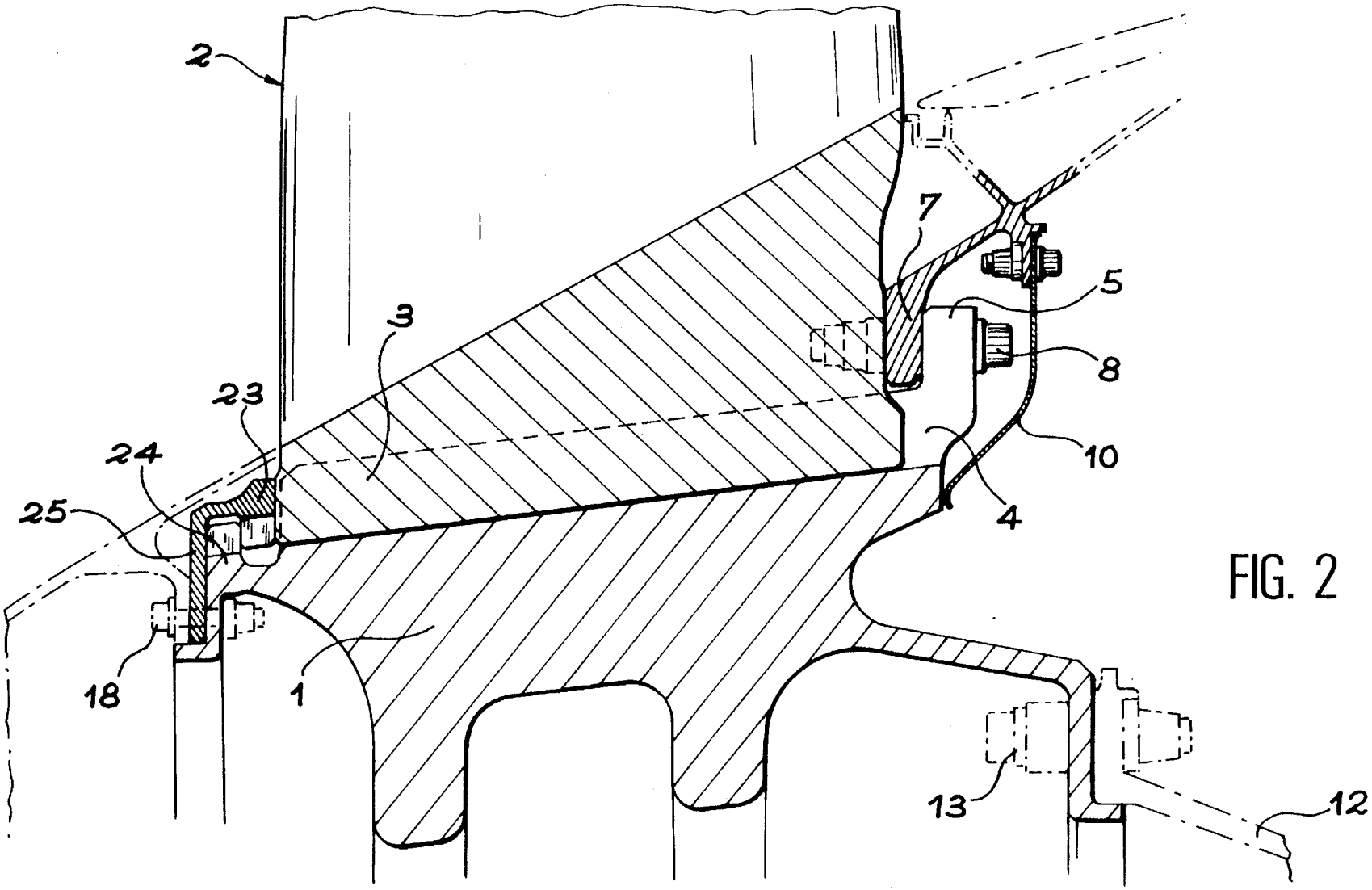

FIG. 2 shows a slightly different design, where the hook 15 is omitted. A pure translatory movement is sufficient for putting the blades 2 into place and there are no shims 17. Under these conditions, the locking of the blades 2 and their wedging towards the downstream side are obtained by a notched ring 23 engaged in a notched collar 24 to the upstream side of the fan disk 1 using a bayonet movement. A collar 25 of the notched ring 23 is wedged between the fan disk 1 and the fan cone 19 by bolts 18. Consequently the same basic effects are obtained, in particular the discharge of the bolts 8.

Figure 3:
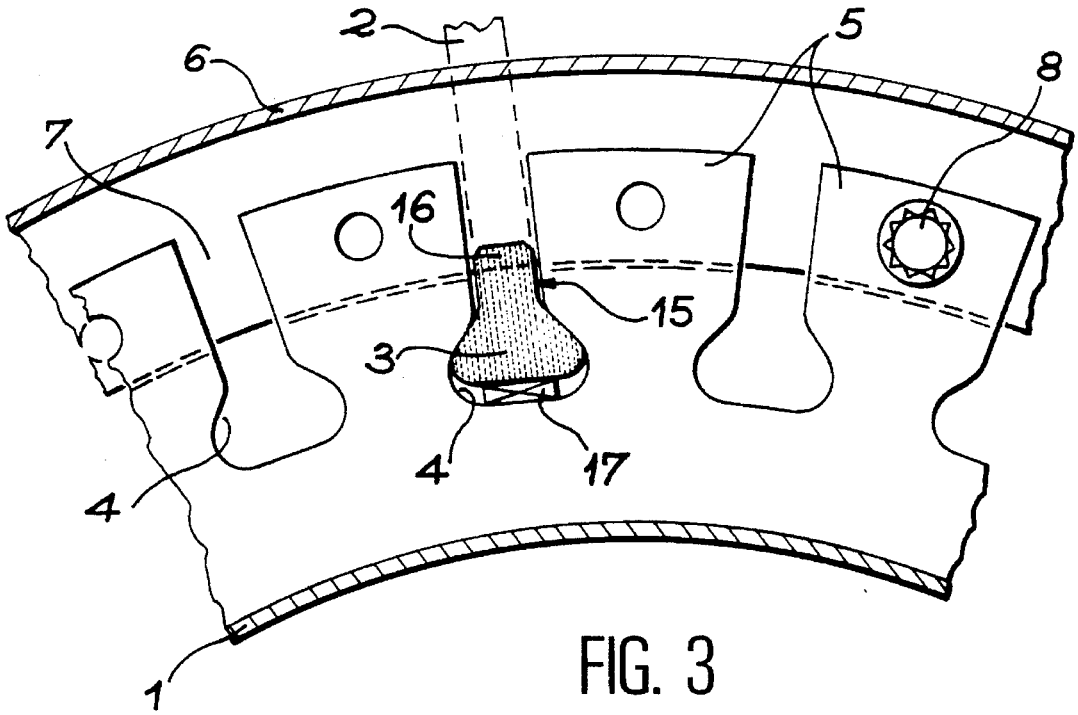
FIGS. 3 and 4 The same embodiments in a view from the downstream side.
Figure 4:
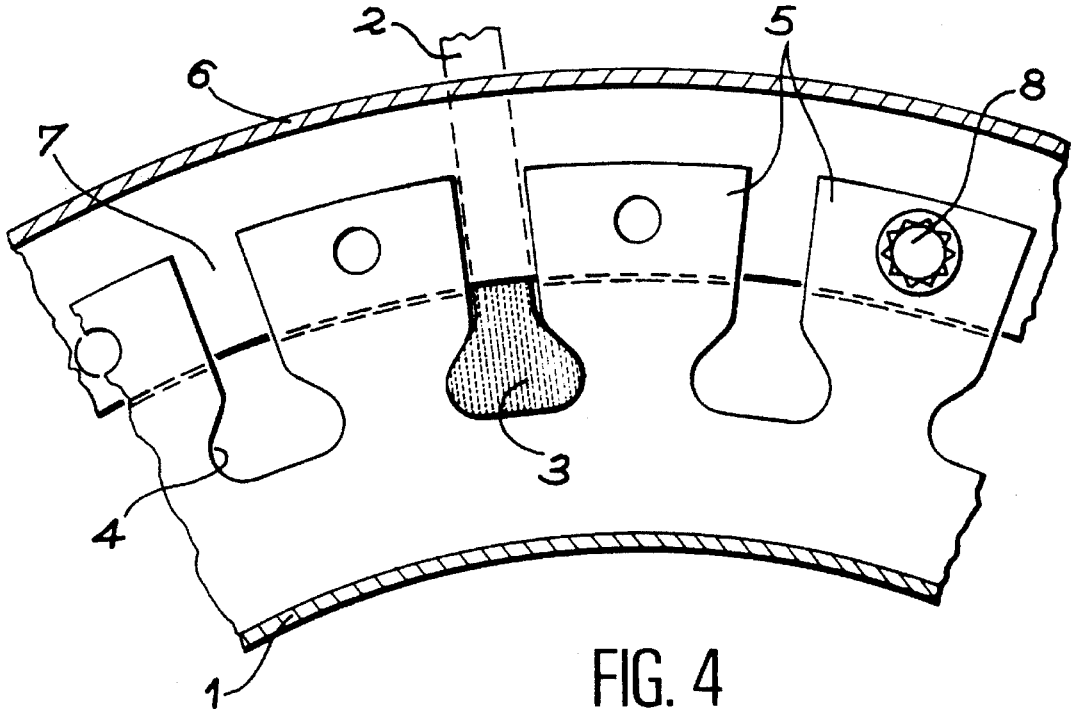

FIGS. 3 and 4 better illustrate the structure of the rotor and in particular the flanges 5 and 7. Certain of the blades 2, whose broachings 4 have been left empty are not shown.

What is claimed is:

1. A turbine engine rotor comprising:

a first section comprising grooves in which roots of blades are retained while being free to slide therein in an axial direction of the grooves and a first flange; and a second section coaxial with the first section and comprising a second flange on which the blades abut in sliding;

wherein the first and second flanges of the first and second sections are secured together by tensile bolts and the second flange of the second section precedes the first flange of the first section in the axial direction so that the second flange is upstream of the first flange.

2. A turbine engine rotor according to claim 1, wherein the grooves issue from the first section on a side opposite to the second section and the blades are pushed back by an abutment ring fixed to said side of the first section.

3. A turbine engine rotor according to claim 2, wherein the first section is a fan disk and the second section a compressor drum.

4. A turbine engine rotor according to claim 3, wherein the ring is part of a fan cone.

5. A turbine engine rotor according to claim 1, wherein shims are placed in the grooves and beneath the roots of the blades, and the blades have a hook extending beneath and behind the second flange of the second section to a side of the first flange of the first section.

6. A turbine engine rotor according to claim 1, wherein the second section carries a sealing collar which covers the grooves.

* * * * *